US005438820A

United States Patent [19]

Nakahara et al.

[11] Patent Number: 5,438,820

[45] Date of Patent: Aug. 8, 1995

[54] COOLING APPARATUS OF A FALSE TEXTURING MACHINE

[75] Inventors: Takeichi Nakahara; Hajime Hino; Takashi Ikeuchi; Tsutomu Ogiso, all of Matsuyama, Japan

[73] Assignee: Teijin Seiki Co., Ltd., Osaka, Japan

[21] Appl. No.: 215,079

[22] Filed: Mar. 21, 1994

[30] Foreign Application Priority Data

Jan. 3, 1993 [JP] Japan ..... 5-098853

[51] Int. Cl.[6] ..... D01H 7/92; D01H 7/46

[52] U.S. Cl. ..... 57/290; 28/249; 57/284; 57/352

[58] Field of Search ..... 28/247, 249, 258; 57/290, 284, 286, 292, 308, 352, 354, 355, 356, 357, 351

[56] References Cited

U.S. PATENT DOCUMENTS 3,368,335 2/1968 Horvath ..... 57/284
4,238,921 12/1980 Steck et al. ..... 57/284
5,148,666 9/1992 Bauer et al. ..... 57/290

FOREIGN PATENT DOCUMENTS 2451415 10/1980 France .
5-117929 5/1993 Japan ..... 57/284
583793 1/1977 Switzerland .

*Primary Examiner*—Daniel P. Stodola
*Assistant Examiner*—William Stryjewski
*Attorney, Agent, or Firm*—Rothwell, Figg, Ernst & Kurz

[57] ABSTRACT

A cooling apparatus of a high speed false texturing machine in which a so-called surging phenomenon is prevented, yarn breakages are not increased, unevenness in yarn dyeing does not occur, and deterioration of crimp characteristics in obtained textured yarn is prevented. A false texturing machine includes a false twisting device (6) for imparting twists to a yarn (2), a heating apparatus (3), disposed upstream from the false twisting device (6), for heat setting twists that run back along the yarn (2), and a cooling apparatus (4, 5), disposed between the heating apparatus (3) and the false twisting device (5), for cooling the yarn. The cooling apparatus (4) has a plurality of partial cooling plates (8). A yarn pressing member (9) serves to insert the yarn (2) into a space between the adjacent partial cooling plates (8) beyond a common contacting line of the adjacent partial cooling plates (8).

15 Claims, 2 Drawing Sheets

COOLING APPARATUS OF A FALSE TEXTURING MACHINE

BACKGROUND OF THE INVENTION

1. Technical Field of the Invention

The present invention relates to an improvement of a cooling apparatus of a false texturing machine, such as a draw texturing machine or a false twist texturing machine. More specifically, the present invention relates to a cooling apparatus of a false texturing machine, by which so called surging phenomenon can be prevented from occurring during the high speed false twisting operation. The so called surging phenomenon refers to a phenomenon wherein a yarn undergoes ballooning, i.e., a kind of rolling of a yarn in a twisting zone when the false twist texturing speed is excessively increased, with abnormal variation in tension of the twisted yarn resulting.

2. Description of Prior Art

A known false texturing machine comprises a false twisting device for imparting twists to a yarn, and a heating apparatus, disposed upstream from the false twisting device, for heat setting twists that run back along the yarn. Further, a known draw texturing machine is provided with a drawing device for drawing the yarn at a predetermined draw ratio prior to or simultaneously with the twist setting by the above-described heating apparatus and the false twisting device.

In a conventional operation, wherein false twist texturing speed is up to 100 m/min, it is sufficient for a yarn to be cooled naturally just after it is heat set by the heating apparatus. In other words, no specifically designed cooling apparatus is required.

However, as the false twist texturing speed increases, the yarn cannot be fully cooled only by conventional natural cooling. In addition, when the twisted yarn runs at a high speed, ballooning at the cooling region increases. Thus, a yarn is forced to run in contact with a cooling apparatus so as to restrict occurrence of the ballooning.

When the false twist texturing speed is further increased and reaches a super high speed, i.e., a speed equal to or higher than 1,000 m/min, a surging phenomenon, i.e., a large waved vibration, occurs in a yarn running through the cooling apparatus. More specifically, the yarn is subjected to ballooning, i.e., rolling, in the twisting zone, and abnormal variation in tension of the twisted yarn occurs. Especially when a high temperature heating apparatus, wherein a yarn is heated to a temperature higher than 300° C., is used, unevenness in dyeing or yarn breakages may occur easily.

It is possible to increase the tension in yarn at the false twisting region in order to obviate the surging phenomenon. However, if this measure is adapted, crimp characteristic in the obtained textured yarn may be adversely affected and yarn breakages may be increased. Consequently, the above-described measure, wherein tension in the yarn at the false twisting zone is enhanced, has a limit for preventing the surging phenomenon.

As another measure for preventing the surging phenomenon, it is possible to shorten the length of a cooling apparatus and to cool the cooling apparatus by means of water or another cooling medium. More specifically, the length of the cooling apparatus is shortened to about 500 mm, and two short cooling apparatus are prepared, and the yarn contacting surfaces of such cooling apparatus are forcibly cooled by means of a cooling medium such as water. However, the construction of the cooling apparatus may be complicated if this measure is applied, and accordingly, the equipment cost and correspondingly the cost for manufacturing false textured yarns are increased.

SUMMARY OF THE INVENTION

It is an object of the present invention to provide a cooling apparatus for a super high speed false texturing machine by which the above-described surging phenomenon can be prevented from occurring.

The present inventors have noticed that the above-described object can be achieved by improving construction of the cooling apparatus.

According to the present invention, the above-described object is achieved in a false texturing machine comprising a false twisting device for imparting twists to a yarn, a heating apparatus, disposed upstream from the false twisting device, for heat setting that twists run back along the yarn, and a cooling apparatus, disposed between the heating apparatus and the false twisting device, for cooling the yarn, wherein the cooling apparatus comprises a yarn contacting and cooling surface, and at least one non-contacting portion is partially disposed in the yarn contacting and cooling surface of the cooling apparatus, and pressing members, for pressing the yarn at the non-contacting portions, disposed correspondingly to the non-contacting portions.

The characteristic feature of the present invention resides in that the non-contacting portions are partially formed in a yarn contacting and cooling surface of the cooling apparatus, and that the yarn is pressed at the non-contacting portions by means of pressing members. Since the yarn is in contact with the pressing members, which are disposed correspondingly to the non-contacting portions, as described above, the pressing members serve as nodes of the vibration, i.e., the ballooning. Accordingly, the resonance frequency of the yarn at the yarn cooling zone is enhanced. As a result, the surging phenomenon does not occur easily. In addition, since the yarn is pressed at the non-contacting portions by means of the pressing members, the tension in the yarn is enhanced. As a result, the resonance frequency of the yarn at the yarn cooling zone is also enhanced, and accordingly, the surging phenomenon does not occur easily.

According to the present invention, due to the prevention of occurrence of the surging phenomenon, the number of yarn breakages decreases (as will be confirmed by the example), and the crimp characteristic of the yarn is improved. Thus, yarn having good quality and being free from unevenness in dyeing can be false textured at a super high speed which is higher than 1,000 m/min.

Further, according to the present invention, it is preferred that the number of the non-contacting portions is at least two as illustrated in the following embodiment, and thus, the effect for preventing the surging phenomenon can be further enhanced.

In this case, it is preferred that the respective yarn contacting and cooling surfaces divided by the non-contacting portions, the number of which is at least two, are formed in a convex shape, since the yarn runs in contact with the respective convex shaped yarn contacting and cooling surfaces divided by the non-contacting portions, and the effect for cooling the yarn is fully enhanced, and the tension in yarn can be maintained at a desired level.

Similarly, it is preferred that the yarn contacting and cooling surfaces are as a whole formed in a convex shape, since the yarn runs in contact with the convex shaped yarn contacting and cooling surfaces, and the effect for cooling the yarn is fully enhanced, and the tension in yarn can be maintained at a desired level.

It is especially preferred that a length of a yarn contacting and cooling surface is between 100 and 500 mm, and a total length of a plurality of yarn contacting and cooling surfaces is between 1,000 and 3,000 mm, and at least one of the angles formed between a common imaginary contacting line for two adjacent yarn contacting and cooling surfaces divided by the non-contacting portion, and a yarn pressed by the pressing members exceeds 0° and is less than 30° as shown in the embodiment below.

BRIEF DESCRIPTION OF THE DRAWINGS

The present invention will now be explained in detail with reference to the accompanying drawings, wherein.

DETAILED DESCRIPTION OF PREFERRED EMBODIMENTS

Figure 1:
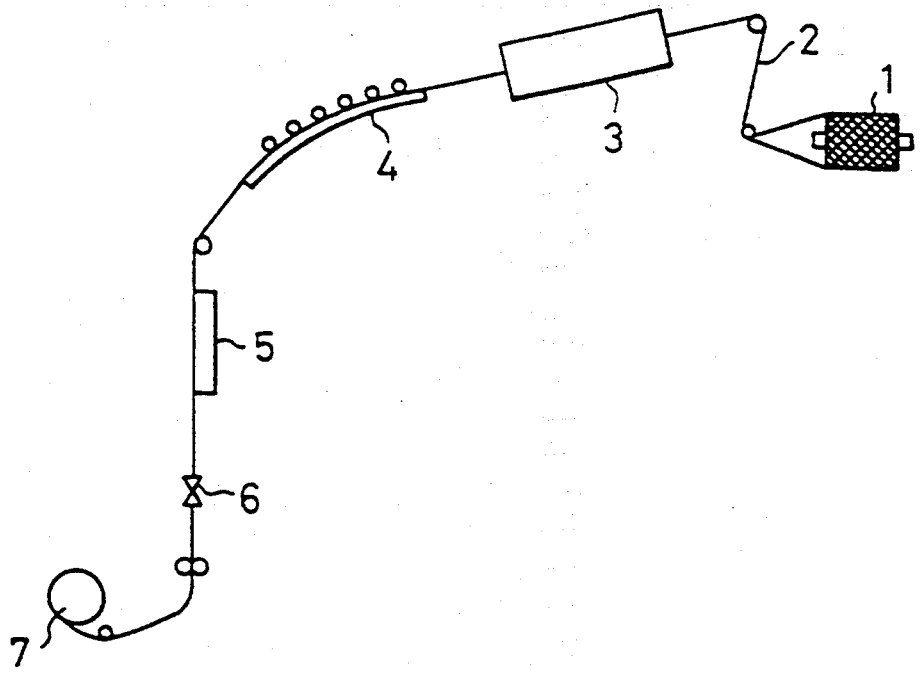
FIG. 1 is a side view schematically illustrating a high speed false texturing machine.

The present invention will now be explained in detail with reference to the accompanying drawings illustrating preferred embodiments of the present invention. Referring to FIG. 1, which is a side view schematically illustrating a high speed false texturing machine, a yarn 2 withdrawn from a supply package 1 is wound into a package by means of a take-up 7 after it passes a heating apparatus 3, cooling apparatus 4 and 5, and a false twisting device 6. Twists imparted by the false twisting device 6 run back along the yarn 2 towards the heating apparatus 3, and the twists are heat set by means of the heating apparatus 3 and the cooling apparatus 4 and 5. More specifically, heat setting is done by cooling the yarn 2, which has been heated by the heating apparatus 3, by means of the cooling apparatus 4 and 5.

Figure 2:
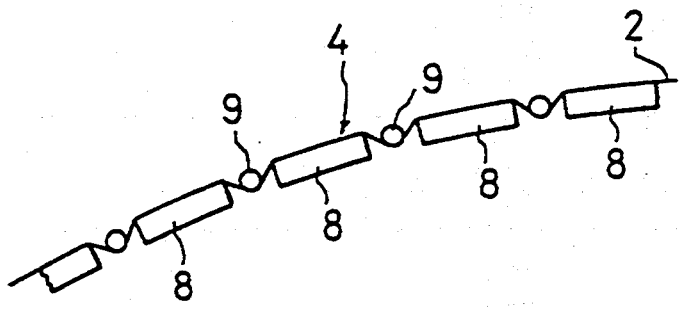
FIG. 2 is a side view of a cooling apparatus of the present invention illustrated in FIG. 1.
Figure 3:
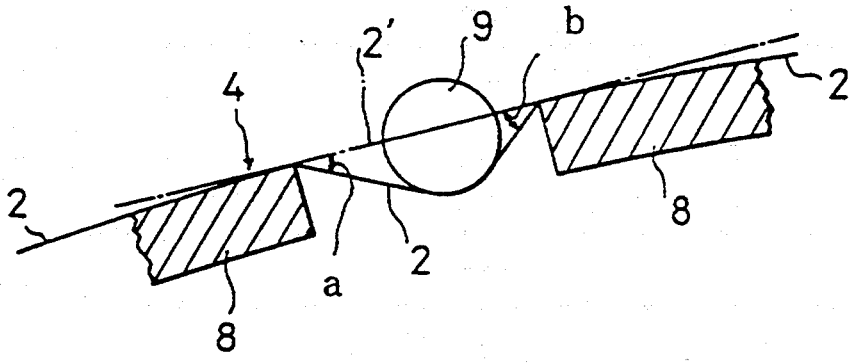
FIG. 3 is a partially enlarged view of FIG. 2.

FIG. 2 is a side view of the cooling apparatus 4 illustrated in FIG. 1, and FIG. 3 is a partially enlarged view of FIG. 2.

Referring to FIG. 2, a plurality of partial cooling plates 8 which have a convex surface, respectively, are disposed in such a manner that they form a small distance therebetween, which distance forms a non-contacting portion, and as a whole form a convex shape. Thus, the cooling apparatus 4 is formed.

The reason why a plurality of partial cooling plates 8 have a convex surface, respectively, and why the cooling apparatus formed by a plurality of partial cooling plates 8 as a whole form a convex shapes is to enhance contacting efficiency of the yarn 2 to the partial cooling plates 8 and the cooling apparatus 4, and thus, to increase cooling efficiency and at the same time to maintain a desired tension in the yarn. The required characteristics of the material suitable for the partial cooling plates 8 are that it be able to cool a yarn 2 quickly, be resistant to friction, that it have a low coefficient of friction against fibers and that its cost be inexpensive. For example, a steel plate may be used for such a cooling plate 8.

In the small distance between the partial cooling plates 8 i.e., at the non-contacting portion, yarn pressing members 9 are located beyond imaginary lines connecting the surfaces of the adjacent partial cooling plates 8 and extend to positions under the surfaces of the partial cooling plates 8.

The yarn pressing members 9 may be movable perpendicular to the yarn passage, and the yarn pressing members 9 may be moved from an operational position illustrated in FIGS. 2 and 3 to a stand-by position, which is away from the operational position, upon threading so as to facilitate easy threading up to the cooling apparatus 4. Alternatively, the yarn pressing members 9 may be disposed at stationary positions at the small distance between the partial cooling plates 8 i.e., at the non-contacting portions, inserted beyond the yarn passage.

FIG. 3 is an enlarged view illustrating the locational relationship between the partial cooling plate 8 and the yarn pressing member 9. The angles "a" and "b" denote the following amounts. The angle "a" denotes an angle formed between a common imaginary contacting line 2' for the yarn contacting surfaces of two adjacent partial cooling plates 8 and a yarn leaving from one of the partial cooling plates to the pressing member 9, while the angle "b" denotes an angle formed between the common imaginary contacting line 2' for the yarn contacting surfaces of two adjacent partial cooling plates 8 and a yarn leaving from the pressing member 9 to the other partial cooling plate 8.

The yarn pressing member 9 may be a stationary pin, or alternatively, it may be a turnable member, such as a roller, in some cases.

The above-described cooling apparatus 4, i.e., the partial cooling plates 8, may be cooled naturally by means of radiation or convection, however, in some cases, it may be cooled by means of a cooling medium, such as water or the like, if desired.

Figure 4:
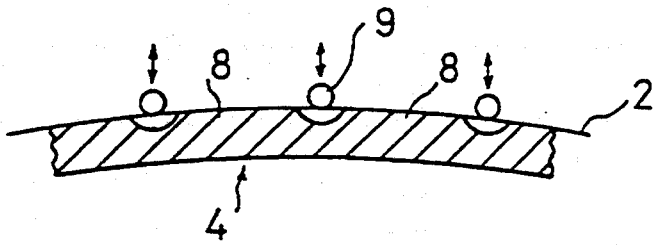
FIG. 4 is a side view of another embodiment of a cooling apparatus of the present invention.

In the above-described embodiment, the partial cooling plates 8 were separated and independent from each other. However, the partial cooling plates 8 may be formed integrally as illustrated in FIG. 4.

Although the above-described explanation was done with reference to the cooling apparatus 4, the cooling apparatus 5 may be constructed in a manner similar to that of the cooling apparatus 4. In some cases, the cooling apparatus 5 may have a construction similar to a conventional one.

Generally speaking, as the false twist texturing speed increases, the length of the cooling apparatus increases in order to ensure cooling of a yarn. When the length of the cooling apparatus increases, a yarn tends to undergo ballooning at the cooling apparatus as described above. In a conventional apparatus, when the texturing speed reaches 1,000 m/min, the surging phenomenon occurs as described above, and a stable texturing operation cannot be expected.

In order to prevent such a surging phenomenon, according to the present invention, the cooling apparatus is constructed with a combination of short partial cooling plates 8, and yarn pressing members 9 disposed at non-contacting portions formed between the partial cooling plates 8. As a result, according to the present invention, a yarn 2 is inserted by means of the yarn pressing members 9 to a position towards the inside of the partial cooling plates 8, i.e., to a lower position under the yarn contacting surfaces of the partial cooling plates 8, beyond the imaginary contacting line 2' connecting the yarn contacting surfaces of the partial cooling plates 8.

Especially when the partial cooling plates 8 are formed in a convex shape, the yarn 2 is pressed by means of the yarn pressing members 9 to a position opposite to the top of the convex shape formed by the partial cooling plate 8 relative to an imaginary curve along the yarn contacting surface of the convex shaped cooling apparatus 4. The curvature of the cooling apparatus 4 may be appropriately selected.

As the length of the partial cooling plates 8 decreases, the surging phenomenon can be prevented from occurring. However, when the total length of the cooling apparatus 4 is constant, the number of the yarn pressing members 9 increases if the length of the respective partial cooling plates 8 is shortened. If the number of the yarn pressing members 9 is excessively increased, run the back of twists may be deteriorated or yarn breakages may occur easily.

When the inserting depth of the yarn pressing member 9 beyond the imaginary curves 2-2'-2 on the cooling apparatus 4 increases, in other words, when the angles "a" and "b" increase, the surging phenomenon can be prevented from occurring. However, if the angles "a" and "b" are excessively large, the run back of twists may be deteriorated or yarn breakages may occur easily.

According to the technical investigation performed by the present inventors, it is ideal that the length of the partial cooling plates 8 be shortened to an amount between 30 and 50 mm, while the number of the yarn pressing members 9 is increased, and while both the angles "a" and "b" are selected to be a small amount, for example about 3°.

However, when such requirements are fully met, the manufacturing cost of the cooling apparatus will be expensive. In addition, knotted portions in a yarn may not smoothly pass through the yarn pressing members, the number of which is excessively large. Thus, difficulty in operational management was often observed.

Taking into consideration the background described above, it is most preferable in order to prevent the surging phenomenon that the length of the partial cooling plates 8 be at least about 100 mm, with the recommended maximum length about 300 mm. When the length of the partial cooling plates exceeds the recommended maximum length, the angles "a" and "b" have to be increased to a sufficiently large amount in order to achieve the effect for preventing the surging phenomenon, and as a result, frequency of yarn breakage increases.

Further, according to the investigation conducted by the present inventors, when the angles "a" and "b" are equal to 0°, any remarkable effect cannot be observed since the yarn is scarcely in contact with the yarn pressing members 9.

When the angles "a" and "b" exceed 0°, effect can be observed, and it is confirmed that the preferred angles "a" and "b" are between 3° and 30° for good run back of twists and small yarn breakage. Especially, the most recommended angles "a" and "b" are between about 3° and about 10°. In this case, when the number of the yarn pressing members 9 increases, run back of twists is not disturbed, and a yarn is not damaged, and therefore, occurrence of yarn breakages does not increase.

EXAMPLES

In a false texturing machine illustrated in FIG. 1, the total length of the cooling apparatus 4 was 1,400 mm, and the radius of curvature was 4 m. The cooling apparatus 4 was equally divided into 3, 5 and 8 partial cooling plates 8. In all the cases, the distance between the adjacent partial cooling plates 8 was 15 mm. Ceramic bars, having a diameter of 5 mm, were prepared as yarn pressing members. Four levels, 0°, 5°, 15°, 30°, were prepared for the angles "a" and "b". The cooling apparatus 5, which was disposed downstream from the cooling apparatus 4, was 300 mm long. The heating apparatus 3 was a high temperature heater of a non-contacting type, having a 1,200 mm length and comprising two stages. The upper stage of the heating apparatus 3 was 400 mm long, and was always set to a temperature of 500° C. The lower stage of the heating apparatus 3 was 800 mm long, and was set to a temperature of 300° C. at a texturing speed of 1,000 m/min, 360° C. at a texturing speed of 1,300 m/min, and 420° C. at a texturing speed of 1,600 m/min. The false twisting device was a false twisting device of a friction type. The supply yarn 1 was polyester POY, i.e., partially oriented yarn, of 115 de/36 fil, and was subjected to a simultaneous draw and texturing operation at draw ratio of 1.53. The results are shown in Table 1.

In Table 1, O denotes good, X denotes bad, and— shows that measurement of physical properties of the obtained textured yarn was impossible since the conditions created a number of yarn breakages. Since good effects were observed at an angle "a" of 5° at a texturing speed of 1,000 m/min, experiences at an angle "a" of 15° or 30°, wherein a yarn will be subjected to a large load, were omitted.

TABLE 1

| | | SURGING | | | YARN BREAKAGES | | | CRIMP CHARACTERISTICS | | | UNEVENNESS IN DYEING | | | TOTAL ESTIMATE | | |
|---|---|---|---|---|---|---|---|---|---|---|---|---|---|---|---|---|
| TEXTURING SPEED (M/MIN) | DIVIDED NUM OF COOLING APPARATUS 4 ANGLE "a" (DEG) | 3 | 5 | 8 | 3 | 5 | 8 | 3 | 5 | 8 | 3 | 5 | 8 | 3 | 5 | 8 |
| 1000 | 0 | X | X | X | X | X | X | — | — | — | — | — | — | X | X | X |
| | 5 | ○ | ○ | ○ | ○ | ○ | ○ | ○ | ○ | ○ | ○ | ○ | ○ | ○ | ○ | ○ |
| | 15 | | | | | | | | | | | | | | | |
| | 30 | | | | | | | | | | | | | | | |
| 1300 | 0 | X | X | X | X | X | X | — | — | — | — | — | — | X | X | X |
| | 5 | X | ○ | ○ | X | ○ | ○ | — | ○ | ○ | — | ○ | ○ | X | ○ | ○ |
| | 15 | ○ | ○ | ○ | ○ | ○ | ○ | ○ | ○ | ○ | X | ○ | ○ | X | ○ | ○ |
| | 30 | ○ | ○ | ○ | ○ | ○ | X | ○ | ○ | — | ○ | ○ | — | ○ | ○ | X |
| 1600 | 0 | X | X | X | X | X | X | — | — | — | — | — | — | X | X | X |
| | 5 | X | ○ | ○ | X | ○ | ○ | — | ○ | ○ | — | ○ | ○ | X | ○ | ○ |
| | 15 | X | ○ | ○ | X | ○ | ○ | — | ○ | ○ | — | ○ | ○ | X | ○ | ○ |

TABLE 1-continued

| | SURGING | YARN BREAK-AGES | CRIMP CHARACT-ERISTICS | UNEVENNESS IN DYEING | TOTAL ESTIMATE |
|---|---|---|---|---|---|
| 30 | ○ ○ ○ | ○ ○ X | ○ ○ — | ○ ○ — | ○ ○ X |

According to the present invention, non-contacting portions are partially formed in a yarn cooling surface, and the yarn is pressed at the non-contacting portions by means of pressing members. Since the yarn is in contact with the pressing members, which are disposed corresponding contacting with the non-contacting portion, as described above, the pressing members serve as nodes of the vibration, i.e., the ballooning, and accordingly, the resonance frequency of the yarn at the yarn cooling zone is enhanced. As a result, the surging phenomenon does not occur easily. In addition, since the yarn is pressed at the non-contacting portions by means of the pressing members, the tension in the yarn is enhanced. As a result, the resonance frequency of the yarn at the yarn cooling zone is also enhanced, and accordingly, the surging phenomenon does not occur easily.

According to the present invention, due to the prevention of occurrence of the surging phenomenon, the number of yarn breakages decreases, and the crimp characteristic of the yarn is increased. Thus, yarn having good quality and being free from unevenness in dyeing can be false textured at a super high speed higher than 1,000 m/min.

We claim:

1. A false texturing machine for treating yarn, the machine comprising:

a false twisting device for imparting twists to a yarn passing through the machine;

a heating apparatus for heat-setting the twists imparted to the yarn by the false-twisting device, the heating apparatus being disposed upstream from the false twisting device with the twists running along the yarn from the false-twisting device toward the heating apparatus; and a cooling apparatus for cooling the yarn, the cooling apparatus being disposed between the heating apparatus and the false twisting device and including:

at least two yarn contacting surfaces which contact and cool the yarn;

a non-yarn contacting portion, in which the yarn does not contact the at least two contacting surfaces said non-yarn contacting portion being disposed between said at least two yarn contacting surfaces such that the yarn extends from one yarn contacting surface, across the non-yarn contacting portion, and to the other yarn contacting surface; and a pressing member disposed at the non-yarn contacting portion which presses the yarn into said portion in a direction which is generally transverse to said yarn contacting surfaces to reduce ballooning of the yarn within the false texturing machine.

2. A machine according claim 6, wherein the cooling apparatus is provided with at least two non-yarn contacting portions each of which is disposed between two adjacent yarn contacting surfaces.

3. A machine according to claim 1, wherein the at least two yarn contacting surfaces of said cooling apparatus each have a convex shape over which the yarn passes.

4. A machine according to claim 1, wherein the at least two yarn contacting surfaces of said cooling apparatus each are disposed relative each other so as to form a combined overall convex shape.

5. A machine according to claim 1, wherein each of said at least two yarn contacting surfaces of said cooling apparatus has a length in the range of from about 100 mm to about 500 mm.

6. A machine according to claim 5, wherein the total combined length of the at least two yarn contacting surfaces is in the range of from about 1,000 mm to about 3,000 mm.

7. A machine according to claim 6, wherein an angle formed between a line connecting the at least two yarn contacting surfaces and the yarn pressed by the pressing member in the direction transverse to said yarn contacting surfaces is greater than 0° but less than 30°.

8. A machine according to claim 1, wherein the pressing member is selectively movable in said generally transverse direction.

9. A false texturing machine comprising:

a false twisting device for imparting twists to a yarn;

a heating apparatus disposed upstream from said false twisting device for heat-setting the twists imparted to the yarn by the false twisting device; and a cooling apparatus for cooling the yarn, the cooling apparatus being disposed between the false twisting device and the heating apparatus and including: at least two adjacent yarn contacting and cooling surfaces which contact and cool the yarn and are divided by a non-yarn contacting zone in which the yarn is not contacted by the cooling apparatus, and a pressing member for pressing the yarn into the non-yarn contacting zone in a direction which forces the yarn against the yarn contacting surfaces;

wherein each of the yarn contacting surfaces has a length between 100 and 500 mm, the combined length of the yarn contacting surfaces is between 1000 and 3000 mm, and wherein an angle formed between a line connecting the at least two yarn contacting surfaces and the yarn pressed by the pressing member in said direction is greater than 0° but less than 30°.

10. A false texturing machine for treating yarn comprising:

a false twisting device for imparting twists to a yarn passing through the machine;

a heating apparatus for heat-setting the twists imparted to the yarn by the false-twisting device, the heating apparatus being disposed upstream from the false twisting device with the twists running along the yarn from the false-twisting device toward the heating apparatus; and a cooling apparatus for cooling the yarn, the cooling apparatus being disposed between the heating apparatus and the false twisting device, the cooling apparatus including:

a one-piece cooling plate with a surface a portion of which contacts and cools the yarn, the cooling plate surface defining a plurality of individual yarn contacting surfaces separated by non-yarn contacting portions which are formed by recesses in the surface, the recesses each being disposed between two adjacent yarn contacting surfaces such that the yarn contacting surfaces and the non-yarn contacting portions are alternately disposed along a length of the cooling plate; and a pressing member disposed adjacent each non-yarn contacting portion which presses the yarn into a portion of the recess to reduce the occurrence of ballooning of the yarn.

11. A machine according to claim 10, wherein the plurality of yarn contacting surfaces of said cooling plate each have a convex shape over which the yarn passes.

12. A machine according to claim 10, wherein the surface of said cooling plate defines an overall convert shape.

13. A machine according to claim 10, wherein each of the plurality of yarn contacting surfaces of said cooling plate has a length in the range of from about 100 mm to about 500 mm.

14. A machine according to claim 13, wherein the total combined length of the plurality of yarn contacting surfaces is in the range of from about 1,000 mm to about 3,000 mm.

15. A machine according to claim 14, wherein an angle formed between a line connecting two adjacent yarn contacting surfaces and the yarn pressed by the pressing member into the recess between the two adjacent yarn contacting surfaces is greater than 0° but less than 30°.

* * * * *

UNITED STATES PATENT AND TRADEMARK OFFICE

CERTIFICATE OF CORRECTION

PATENT NO. : 5,438,820

DATED : August 8, 1995

INVENTOR(S) : Takeichi Nakahara et al.

It is certified that error appears in the above-indentified patent and that said Letters Patent is hereby corrected as shown below:

cover page: Under the subheading, "FOREIGN APPLICATION PRIORITY DATA", the filing date for the Japanese Patent Appl. No. 5-098853 should be -- March 31, 1993 --;

Col. 2, line 20, "that twists" should be -- twists that --; Col. 3, line 16, after "members" insert a comma; Col. 3, line 60, "shapes" should be -- shape, --; Col. 5, line 19, after "increased," insert -- the --; Col. 5, line 20, delete "the"; Col. 7, line 13, "corresponding contacting" should be -- correspondingly --;

In the Claims:

Col. 7, line 48 (claim 1), after "two" insert -- yarn --;

Col. 7, line 61 (claim 2), after "according" insert -- to --; Col. 7, line 61 (claim 2), "claim 6" should be -- claim 1 --; Col. 8, line 10 (claim 4), after "relative" insert -- to --.

Signed and Sealed this

Fifth Day of December, 1995

*Attest:*

*Attesting Officer*

Bruce Lehman

BRUCE LEHMAN

*Commissioner of Patents and Trademarks*